United States Patent [19]

Molpus

[11] 4,036,486

[45] July 19, 1977

[54] STOP MEANS FOR MAT BOARD CUTTER

[75] Inventor: Homer B. Molpus, Jackson, Mich.

[73] Assignee: C & H Manufacturing Company, Jackson, Mich.

[21] Appl. No.: 712,157

[22] Filed: Aug. 6, 1976

[51] Int. Cl.[2] ..... B26D 5/08

[52] U.S. Cl. ..... 269/303; 83/468; 269/319

[58] Field of Search ..... 269/303, 304, 305, 306, 269/307, 319; 83/455, 468, 614

[56] References Cited

U.S. PATENT DOCUMENTS

| | | | |
|---|---|---|---|
| 2,835,156 | 5/1958 | Eklund | 269/303 |
| 3,274,689 | 9/1966 | Schott | 269/303 |
| 3,779,119 | 12/1973 | Broides | 83/468 |

*Primary Examiner*—James L. Jones, Jr.
*Assistant Examiner*—Robert C. Watson
*Attorney, Agent, or Firm*—Bacon & Thomas

[57] ABSTRACT

A pair of stop blocks have clamping elements for clamping the blocks in selected positions along a guide rail for a mat cutter and in predetermined relation to the edges of a mat to be cut. The stop blocks serve to precisely determine the start and finish of a line of cut. One of the stop blocks has a feeler rod adjustable thereon in a direction parallel to the guide rail for engagement with an edge of the mat board to thereby position the stop block to engage the cutter when the latter is a predetermined distance inwardly from the edge of the mat board.

4 Claims, 4 Drawing Figures

STOP MEANS FOR MAT BOARD CUTTER

BACKGROUND OF THE INVENTION

This invention is in the field of mat board cutters and relates particularly to stop means for a movable cutter.

In the picture framing and related arts, it is customary to cut a mat board of a size to fit within the desired frame and having a central sight opening, usually rectangular, through which the picture being framed is visible. Customarily, the sight opening is rectangular having straight edges cut at a bevel through the relatively thick mat board. The proper cutting of such sight openings normally requires considerable skill to start and end each cut at precisely the right position so that the product is not "over-cut" or "under-cut". An over-cut product is one wherein the cutting blade cuts the product beyond the desired point producing a mat which is unsightly and which to an extent would not be merchantable or which is at least of poor craftsmanship. An under-cut is wherein the cutting blade does not cut the mat to the desired point and in removing the waste material unsightly ragged portions remain which must be manually trimmed or sanded, which is usually visible, resulting in an inferior product.

SUMMARY OF THE INVENTION

It is a principal object of this invention to provide for improved uniformity of cutting beveled edges or lines in making picture framing mats.

Another object of this invention is to provide stop means for a mat cutter which will eliminate an "over-cut" product.

Another object of this invention is to provide stop means for a mat cutter which will eliminate an "under-cut" product.

A further object of this invention is to provide repeated precision cut mat boards or products thereby enabling the user to produce the desired cut material on a repeated and consistent basis.

A still further object of this invention is to provide a mechanical guide to produce a beveled or straight cut that is precise and uniform in length, eliminating the errors of human judgement and user experience necessary in determining the point at which the cutting blade enters the material to begin the cut and the point at which the cutting blade ceases to cut the material.

It is still another object of the invention to provide adjustable stop means for a mat cutter which are economical to manufacture, simple to install, easy to use and reliable in operation.

DESCRIPTION OF A PREFERRED EMBODIMENT

Figure 1:
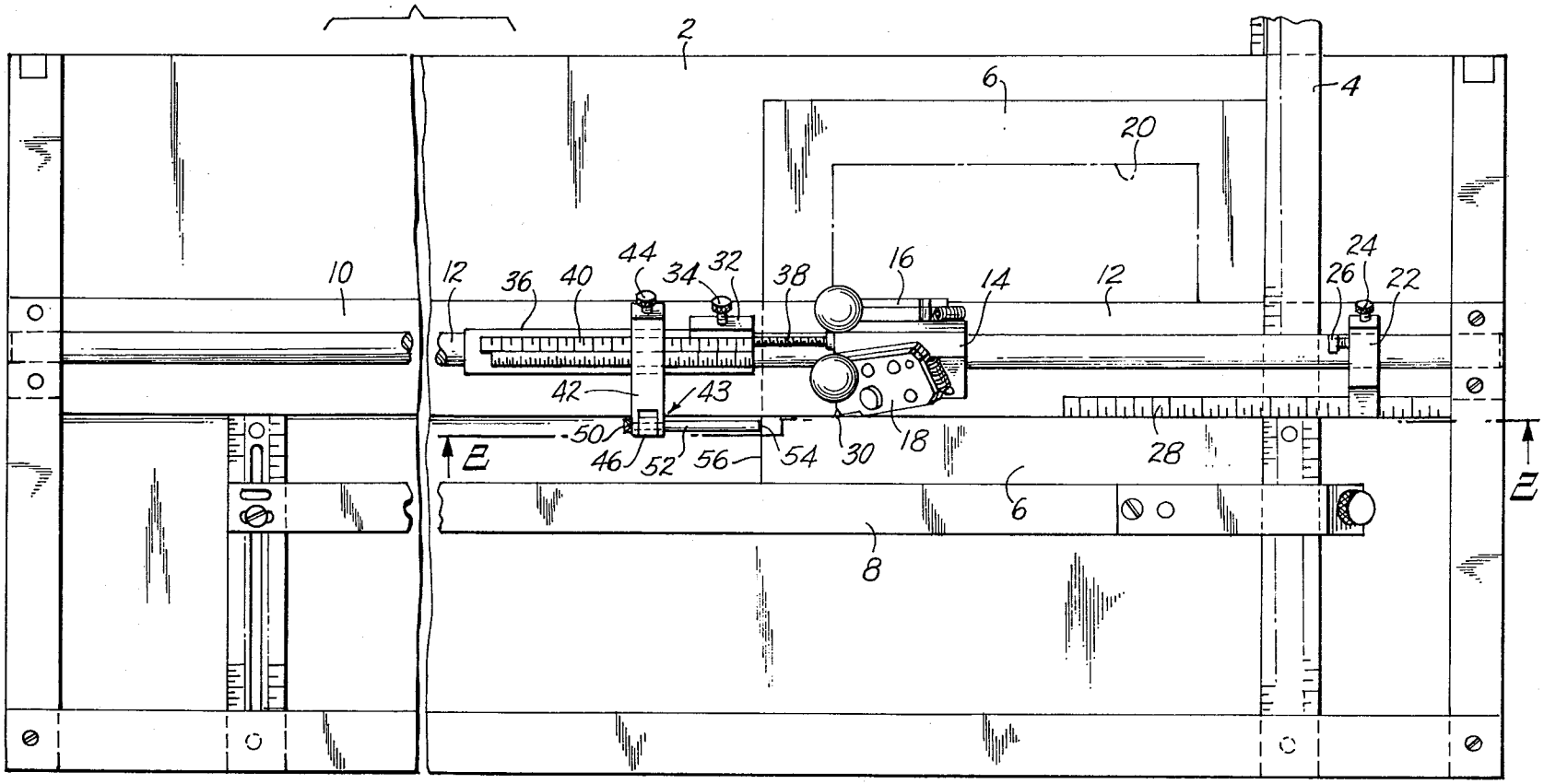
FIG. 1 is a fragmentary plan view of a mat board cutting device incorporating the present invention.

In the drawings numeral 2 designates a baseboard having an abutment straightedge 4 thereon and against an edge of which a mat board 6 may be positioned. Such devices are conventional and usually include a further straightedge member 8, adjustable in a direction lengthwise of the abutment straightedge 4 to engage an adjacent edge of the mat board 6 and precisely position it on the base 2 at the desired distance from a line of cut, to be described. Clamping straightedge or bar 10, which can only be raised or lowered with respect to the base 2, extends over a mat board 6 to clamp the same against the base. Mounted on the clamp bar 10 is a guide rail 12, parallel to straightedge 8, and along which a cutter-carrying body 14 is slidable. The body 14 usually carries a pair of cutter devices 16 and 18 wherein 16 makes a vertical cut and 18 makes a beveled cut. The cutter 16 is generally employed to cut the outer outline of the mat board 6 to the desired dimensions and with vertical edges. The cutter 18 is employed to cut the edges of the sight opening 20 at a bevel. The structure thus far described is conventional and known in the art.

Figure 4:
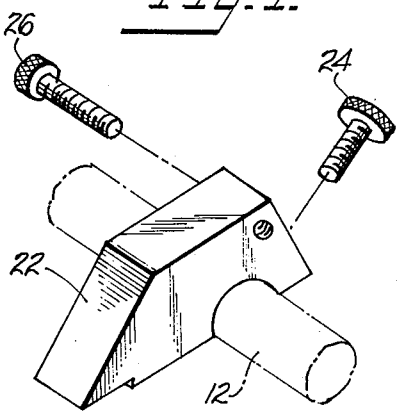
FIG. 4 is an enlarged isometric view of the finishing stop block.

The present invention is adapted to be used with such a mat board cutter as described above and comprises a first stop block 22 shown in detail in FIG. 4. The stop block 22 is configured with a recess adapted to embrace the guide rail 12 and has a clamping screw 24 whereby it may be clamped in fixed position on the guide rail. An adjustable stop member 26 is threadedly supported by the block 22 and extends generally parallel to the guide rail 12 toward the cutter-carrying body 14. The clamp bar 10 may be provided with a suitable scale 28 cooperating with an edge of a nose portion of the stop block 22 to indicate the position of the latter. It is contemplated that the block 22 will be clamped to the guide rail 12 in such position that when the cutter carrying body 14 abuts the stop member 20, the pointed cutter 30 will be precisely at an end of one edge of the desired cut to form sight opening 20.

Figure 3:
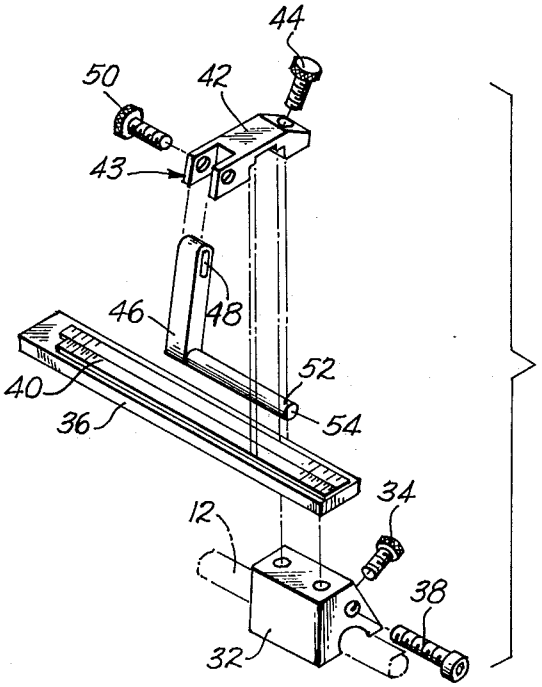
FIG. 3 is an exploded isometric view of the starter stop block and the elements associated therewith.

A second stop block 32 is likewise provided with a recess whereby it may embrace the guide rail 12 and a clamping screw 34 by which it may be clamped in desired position on the rail 12. The stop block 32 includes a support bar 36 fixed thereto and extending generally in a direction away from the cutter carrying body 14 above and parallel to rail 12. A stop member 38 is threaded into the stop block and extends toward the cutter-carrying body 14. The support bar 36 is also provided with suitable scale means 40 to indicate the position therealong of an adjustable element 42 having a clamping screw 44 whereby it may be clamped to the support bar 36 in a desired position therealong. The element 42 is formed at one end to define a bifurcated bracket portion 43, as clearly seen in FIG. 3, between the wings of which an end of an arm 46 is positioned. The arm 46 is of a width substantially equal to the spacing between the wings of element 42 and is provided with an elongated slot 48 at its upper end. A pivot pin or screw 50 extends through the wings of the bracket portion 43 and through the slot 48 of arm 46 whereby the arm is not only pivotal relative to the element 42 but is also capable of limited vertical sliding movement.

At its lower end the arm 46 is provided with a horizontally extending feeler rod 52 fixed thereon and extending generally toward the cutter carrying body 14. The rod 52 has a positioning surface 54 at its end. In operation, the mat board 6 is first cut to the desired outer dimensions either by means of the cutter 16 or in any other manner and is placed on the base 2 in the position shown. The straightedge 8 may be set to determine the width of the mat border at the corresponding side edge of the mat board. The operator predetermines the desired width of the border to be formed at the end edges of the mat, that is, the distance from the outer edges of the ends of the mat board to the adjacent edge of the sight opening 20. The stop block 22 is then positioned on the guide rail 12 at a position wherein the scale 28 indicates the desired border width referred to and clamped in place. The element 42 is then adjustably positioned along the support bar 36 so that the scale 40 thereon indicates the same border width as referred to previously, if opposite end borders are to be the same width, and the element 42 is then clamped to the support bar. The stop block 32, carrying the support bar, is then clamped in position on the guide rail 12 at such a location that the positioning surface 54 of feeler rod 52 abuts or engages the adjacent edge 56 of the mat board 6. The arrangement is such that with the stop blocks 22 and 32 positioned as described, the stop members 26 and 38 are in position to engage the ends of cutter-carrying body 14 to limit its movement and thereby the length of the cut. The stop members 26 and 38 may be readily adjusted to precisely position the point of the cutter 30 at exactly the desired starting and finishing points of the cut to be made. After a first cut has been made, assuming it to be the long side of the sight opening 20, the opposite long side may be cut in the same manner by merely reversing the mat board on the base 2. Thereafter, the mat board is positioned to present the short end edges against the straightedge 8, the stop block 32 is released from rail 12 and moved toward the mat board until the positioning surface 54 of the feeler rod 52 engages the long edge of the mat board. The block 32 is then clamped in that position and the operator is ready to make the final two cuts in the mat.

Figure 2:
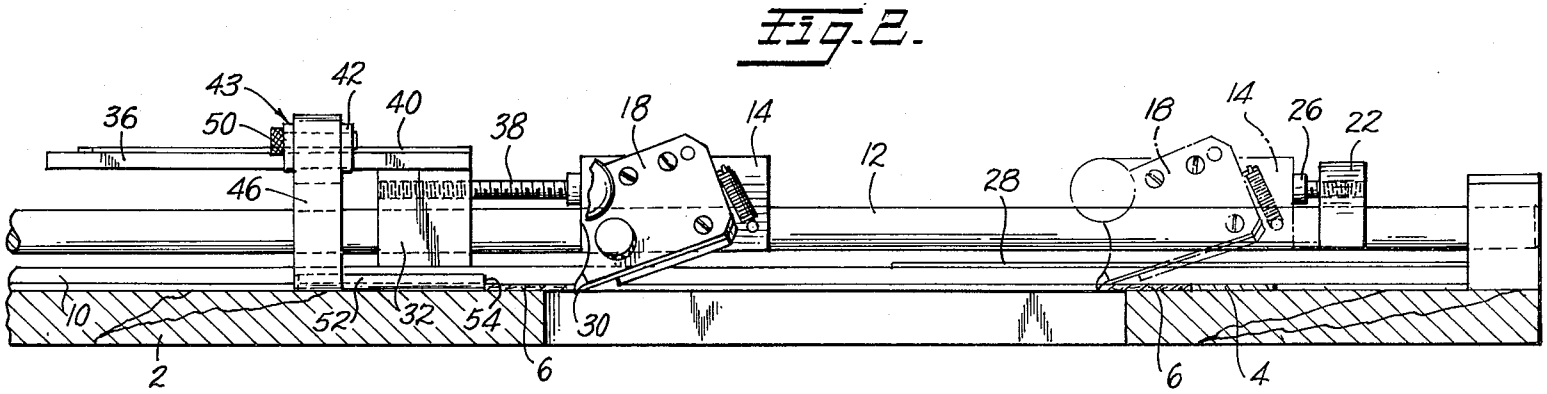
FIG. 2 is an enlarged fragmentary vertical sectional view, taken on the line 2—2 of FIG. 1 showing the cutting knife at the beginning of a cut in solid lines and at the end of the cut in phantom lines.

FIG. 2 illustrates the position of the cutter-carrying body 14 and the cutters thereon at both the start and finish of its cut. The cutters are preferably mounted for pivotal movement on the body 14 and are normally held in an upper position by conventional spring means. To start a cut, the body 14 is abutted against stop member 38 which has been precisely adjusted so that the cutter 30 enters the mat board at exactly the right point. The cutter is then pressed downwardly and drawn along guide rail 12 until the body 14 engages stop member 26. This completes the cut at precisely the correct starting and ending points.

Mat boards employed in picture framing are not all of the same thickness. The thickness of conventionally used mat boards vary greatly, some being as much as three times as thick as others. The slot 48 in arm 46 compensates for the different thicknesses of mat board since it supports the feeler rod 52 for vertical and pivotal movement. When a thicker mat board is being cut, obviously the clamp bar 10 and guide rail 12 are at a greater distance from the base 2 and this, of course, raises the stop block 32 a corresponding distance. Under such circumstances the arm 46 may drop farther downwardly so that feeler rod 52 rests on the upper surface of base 2 to ensure proper contact with the edge of the mat board. When the arm 46 and feeler rod have been set for the particular thickness of mat board to be cut, the threaded pivot 50 may be tightened to flex the wings of the bracket portion 43 and thus fix the feeler rod in the desired position.

While a specific embodiment of the invention has been shown and described herein, the same is merely illustrative of the principles involved and other forms may be resorted to within the scope of the appended claims.

I claim:

1. In a mat board cutter having a base with abutment means for positioning a mat board thereon, a clamp bar for clamping the mat board on said base, a guide rail on said clamp bar for guiding a mat cutter therealong and a cutter-carrying body slidable along said guide rail, the improvement comprising:

a pair of stop blocks selectively adjustable along said guide rail on respectively opposite sides of said body and each having a stop member thereon in position to engage said body to predetermine the start and finish of a cut made by the cutter thereon, both said stop members being selectively adjustable, relative to said stop blocks, in a direction generally parallel to said guide rail, a first one of said stop blocks being adjacent said abutment means;

the other of said stop blocks having a positioning member thereon engageable with the edge of said mat board opposite said one edge, said positioning member being adjustably mounted on said other stop block.

2. A cutter as defined in claim 1 including a scale on said other stop block for indicating the position of adjustment of said positioning member thereon.

3. A cutter stop comprising:

a stop block having means for clamping the same to a cutter guide rail at a selected position therealong;

a stop member on said block;

said stop block having a support bar fixed thereon and extending in a direction away from said stop member;

a positioning member adjustable along said support bar and having a positioning surface laterally spaced from said stop block for engaging an edge of the mat board to be cut to position said stop member in predetermined relation to said edge of the mat board, said positioning surface being the end of a feeler rod pivotally mounted on said positioning member for pivotal movement toward and from the plane of the mat board, said feeler rod extending generally parallel to said support bar.

4. A cutter stop as defined in claim 3 wherein said feeler rod is secured to an arm having an elongated slot therethrough pivotally and slidably embracing a pivot pin on said positioning member.

* * * * *

UNITED STATES PATENT OFFICE

CERTIFICATE OF CORRECTION

Patent No. 4,036,486 Dated July 19, 1977

Inventor(s) HOMER B. MOLPUS

It is certified that error appears in the above-identified patent and that said Letters Patent are hereby corrected as shown below:

On the title page, line [75] read "Jackson, Mich." as --Jackson, Miss.-- and in [73], second line, read "Jackson, Mich." as --Jackson, Miss.--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*